US008347859B2

(12) United States Patent
Garon et al.

(10) Patent No.: US 8,347,859 B2
(45) Date of Patent: Jan. 8, 2013

(54) AUTOMATIC THROTTLE CALIBRATION IN A MARINE VESSEL

(75) Inventors: Pierre Garon, Trois-Rivières (CA); Thomas Samuel Martin, Vancouver (CA)

(73) Assignee: Marine Canada Acquisition Inc., Richmond (CA)

( * ) Notice: Subject to any disclaimer, the term of this patent is extended or adjusted under 35 U.S.C. 154(b) by 388 days.

(21) Appl. No.: 12/703,281

(22) Filed: Feb. 10, 2010

(65) Prior Publication Data

US 2010/0275879 A1 Nov. 4, 2010

(51) Int. Cl.
*F02D 11/00* (2006.01)
*F02D 45/00* (2006.01)

(52) U.S. Cl. ..... 123/399; 123/339.14

(58) Field of Classification Search ..... 123/399, 123/319, 339.1, 339.14, 339.15, 337; 701/21; 440/1, 84, 87

See application file for complete search history.

(56) References Cited

U.S. PATENT DOCUMENTS

| | | | | |
|---|---|---|---|---|
| 4,071,818 | A | 1/1978 | Krisst | |
| 4,350,041 | A | 9/1982 | Loker et al. | |
| 4,898,132 | A | 2/1990 | Kanno | |
| 4,950,988 | A | 8/1990 | Garshelis | |
| 5,228,548 | A | 7/1993 | Bohlin | |
| 6,026,783 | A * | 2/2000 | Nestvall et al. | 123/399 |
| 6,587,765 | B1 | 7/2003 | Graham et al. | |
| 6,595,179 | B1 | 7/2003 | Kanno | |
| 6,823,745 | B2 | 11/2004 | Goto et al. | |
| 6,871,555 | B2 | 3/2005 | May | |
| 7,036,485 | B1 | 5/2006 | Koerner | |
| 7,131,339 | B2 | 11/2006 | Kwun et al. | |
| 7,133,758 | B2 | 11/2006 | Otto et al. | |
| 7,142,955 | B1 | 11/2006 | Kern et al. | |
| 7,179,143 | B2 | 2/2007 | Mizuguchi et al. | |
| 7,330,782 | B2 | 2/2008 | Graham et al. | |
| 7,335,070 | B2 | 2/2008 | Yoda et al. | |
| 7,384,321 | B2 | 6/2008 | Muramatsu et al. | |
| 7,469,604 | B2 | 12/2008 | Hedayat et al. | |
| 2003/0204291 | A1 * | 10/2003 | Graham et al. | 701/21 |
| 2004/0090195 | A1 | 5/2004 | Motsenbocker | |
| 2004/0209731 | A1 * | 10/2004 | Graham et al. | 477/2 |
| 2006/0166573 | A1 | 7/2006 | Vetta et al. | |
| 2007/0227268 | A1 | 10/2007 | Ouyang et al. | |
| 2008/0216589 | A1 | 9/2008 | Shimizu | |
| 2008/0314175 | A1 | 12/2008 | Egle et al. | |

OTHER PUBLICATIONS

AS5045 12 Bit Programmable Magnetic Rotary Encoder, www.austriamicrosystems.com, 2008.

AS5000 Series Magnetic Sensor Circuits, Magnet Selection Guide, www.austriamicrosystems.com, 2008.

BRP Evinrude Icon Interactive Control System Press Release, Feb. 12, 2009, Bombardier Recreational Products Inc., Miami, Florida.

* cited by examiner

*Primary Examiner* — Mahmoud Gimie
(74) *Attorney, Agent, or Firm* — Cameron IP

(57) ABSTRACT

A method of calibrating throttle controls in an electronic shift and throttle system includes opening the throttle and then moving the throttle back towards a hard stop in increments. The voltage level of an electrical signal sent by a throttle position sensor is measured and recorded at each increment. An idle position is established as being where the lowest voltage level was measured when the throttle is at least 0.75° away from the hard stop.

17 Claims, 16 Drawing Sheets

| Lever position | Gear command | Throttle command | Gear lamps |
|---|---|---|---|
| FORWARD WOT | Forward | 100% | 32 |
| FORWARD | Forward | 0 - 100% | |
| FORWARD DETENT | Forward | 0% | |
| NEUTRAL DETENT | Neutral | 0% | 34 |
| REVERSE DETENT | Reverse | 0% | |
| REVERSE | Reverse | 0 - 60% | |
| REVERSE WOT | Reverse | 60% | 36 |

FIG. 6

AUTOMATIC THROTTLE CALIBRATION IN A MARINE VESSEL

BACKGROUND OF THE INVENTION

1. Field of the Invention

The present invention relates to electronic shift and throttle systems and, in particular, to calibrating throttle actuators.

2. Description of the Related Art

Vehicles such as marine vessels are often provided with electronic shift and throttle systems. These systems typically allow an operator to control the shift and throttle functions of a propulsion unit using a control lever which is pivotally mounted on a control head. The control lever is moveable between a forward wide open throttle (forward WOT) position and a reverse wide open throttle (reverse WOT) position, through a neutral position. A controller reads the position of the control lever as the control lever moves through its operational range. The controller sends shift commands and throttle commands which drive a shift actuator and a throttle actuator based on the position of the control lever.

For example, U.S. Pat. No. 7,330,782 issued on Feb. 12, 2008 to Graham et al. and the full disclosure of which is incorporated herein by reference, discloses an electronic shift and throttle system in which a position sensor is used to sense the position of a control lever. The position sensor is electrically connected to an electronic control unit (ECU) and sends an electrical signal to the ECU. The ECU is able to determine the position of the control lever based on the voltage level of the electrical signal received from the position sensor. The ECU then determines the positions to which the output shafts of the shift actuator and the throttle actuator should be set.

Each of the output shafts is also coupled to a corresponding position sensor. Electrical signals sent by these position sensors may be used to determine the positions of the output shafts. This feedback may be used to govern the ECU. This is beneficial because variances and play between components used to link throttle actuators to throttles make it desirable to calibrate throttle controls.

SUMMARY OF THE INVENTION

It is an object of the present invention to provide an improved method and system for calibrating throttle controls.

There is accordingly provided an improved method for calibrating throttle actuators in an electronic shift and throttle system. The method includes opening a throttle and subsequently moving the throttle back towards a hard stop in increments. The voltage level of an electrical signal sent by a throttle position sensor (TPS) at each increment is measured and recorded. An actuator sensor senses the position of an actuator arm at each increment. An idle position of the actuator arm is established where the lowest valid voltage was measured prior to the hard stop. In a preferred embodiment of the method, the actuator position sensor senses a rotary position of an output shaft which drives the actuator arm as the throttle is moved towards the hard stop in increments of 1°.

The calibrated idle position is stored in EEPROM if certain parameters are met. In a preferred embodiment the following parameters should be met:

(a) the idle position is at least 0.75° away from the hard stop;

(b) the voltage level of the electrical signal sent by the TPS has changed more than 0.2V while calibrating;

(c) the voltage level of the electrical signal sent by the TPS when the throttle is in the idle position is greater than 0.3V; and (d) the voltage level of the electrical signal sent by the TPS when the throttle is in the idle position is less than 0.62V.

Also provided is an improved electronic shift and throttle system. The electronic shift and throttle system comprises a throttle actuator including a motor for rotating an output shaft which in turn transfers motion to an actuator arm. An actuator position sensor senses a rotating position of the output shaft, and preferably, a position of a magnet disposed on the output shaft. A linkage connects the actuator arm to a throttle which is moveable between a hard stop and an open throttle position. There is a controller for commanding the throttle actuator to open the throttle and subsequently move the throttle towards the hard stop in increments. A memory records a voltage level of an electrical signal sent by the throttle position sensor at each increment. A microprocessor correlates the rotating position of the output shaft with movement of the throttle based on the voltage level of the electrical signal, a duty cycle of the actuator position sensor and an amount current flowing into the motor.

The present invention provides an improved method and system for calibrating throttle controls that eliminates the need for additional tools to calibrate, or operator training to calibrate, and without human error. Using force detection, angular position of the throttle actuator arm and the voltage level of the electrical signal from the throttle position sensor provides a more robust calibration method.

BRIEF DESCRIPTIONS OF DRAWINGS

The invention will be more readily understood from the following description of the embodiments thereof given, by way of example only, with reference to the accompanying drawings, in which:

FIG. 6 is a table illustrating the lighting of indicator or gear lamps as the control lever of FIG. 5 is moved through the operational range;

DESCRIPTION OF THE PREFERRED EMBODIMENTS

Figure 1:
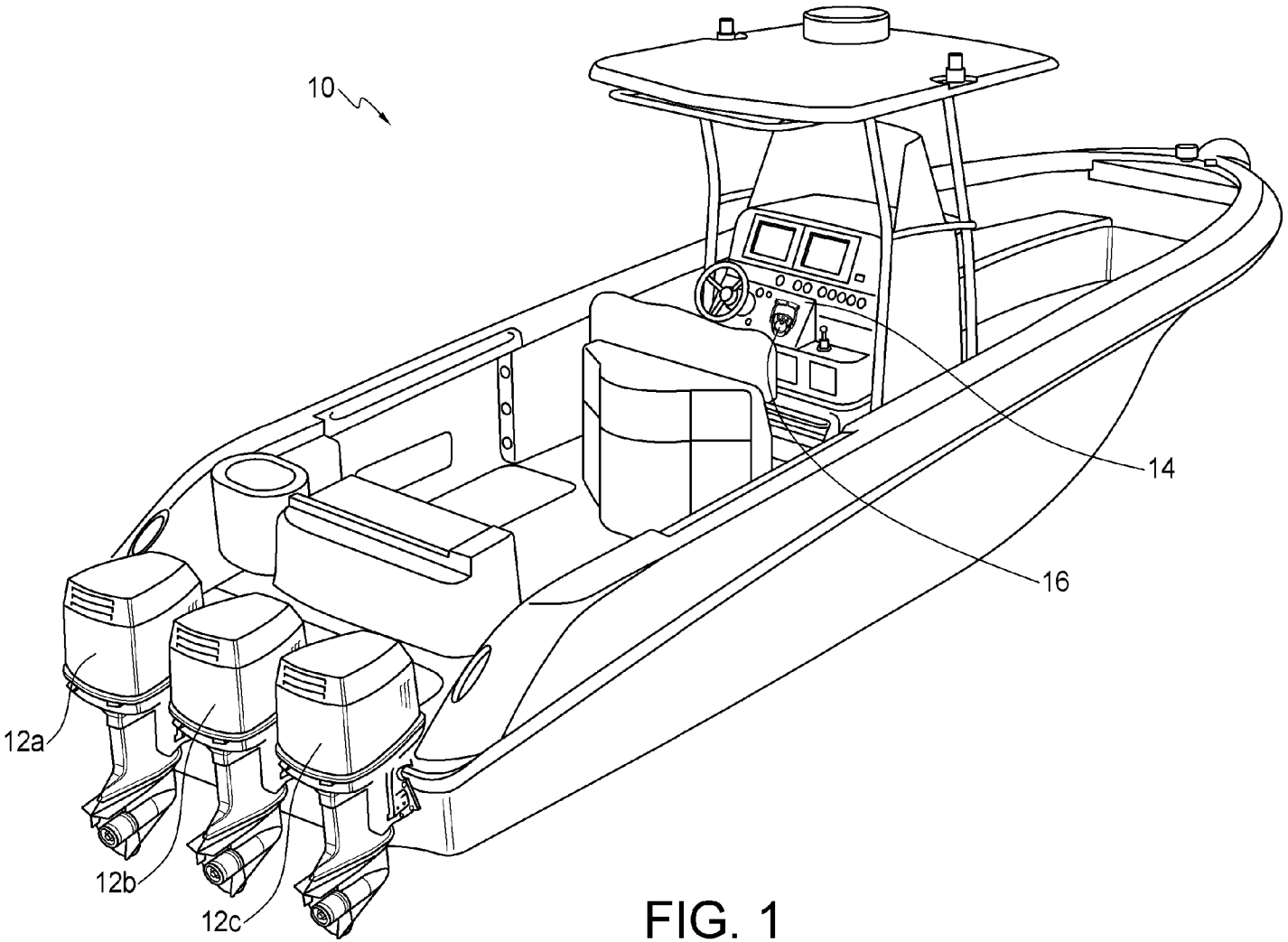
FIG. 1 is a perspective view of a marine vessel provided with a plurality of propulsion units and an improved electronic shift and throttle system.

Referring to the drawings and first to FIG. 1, this shows a marine vessel 10 which is provided with a plurality of propulsion units in the form of three outboard engines 12*a*, 12*b* and 12*c*. However, in other examples, the marine vessel 10 may be provided with any suitable number of inboard and/or outboard engines. It is common to see two engines and practically up to five engines in pleasure marine vessels. The marine vessel 10 is also provided with a control head station 14 that supports a control head 16. The control head 16 is provided with a microprocessor (not shown).

Figure 2:
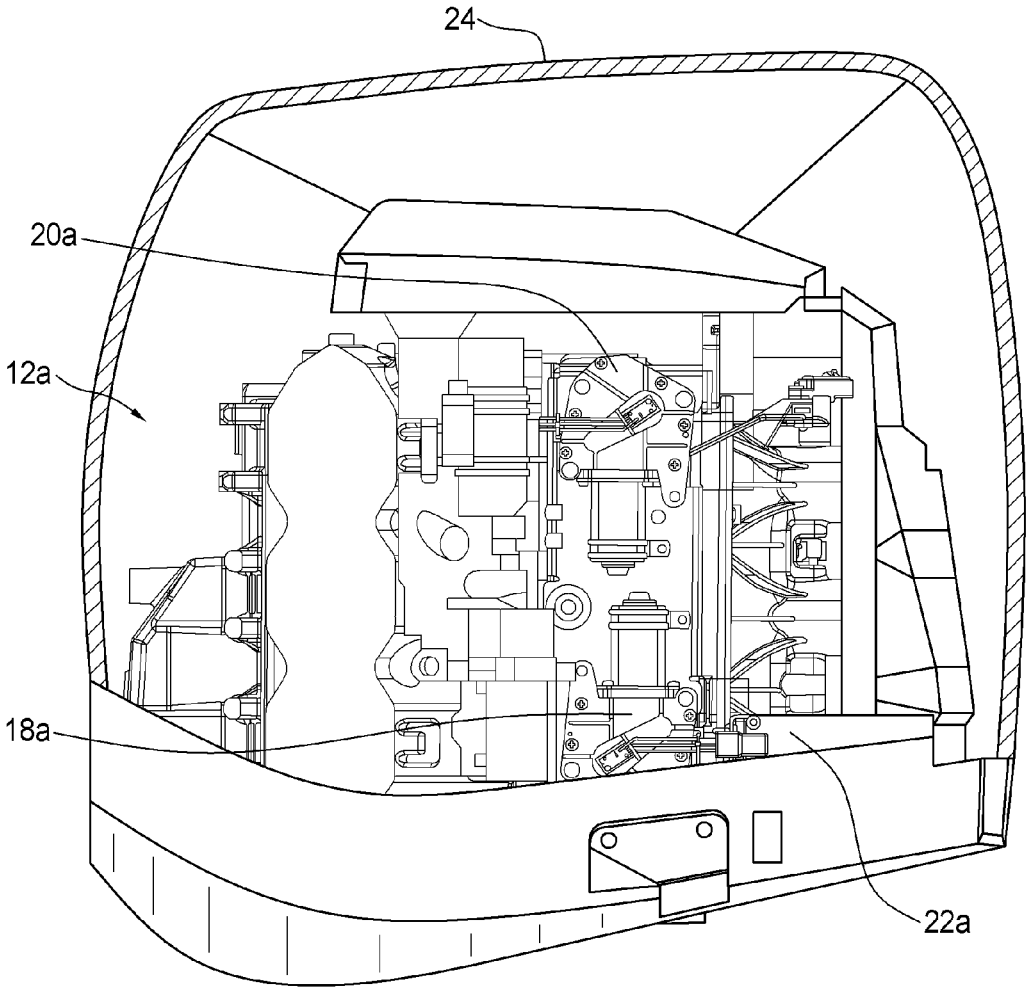
FIG. 2 is a side view of an engine of one of the propulsion units of FIG. 1.

A first one of the engines, namely the port engine 12*a*, is best shown in FIG. 2. The port side engine 12*a* includes a shift actuator 18*a*, a throttle actuator 20*a*, and an electronic servo module (ESM) 22*a*; all of which are disposed within a cowling 24. Second and third ones of the engines, namely the center engine 12*b* and starboard 12*c* engine, have substantially the same structure as the port engine 12*a* and are accordingly not described in detail herein.

Figure 3:
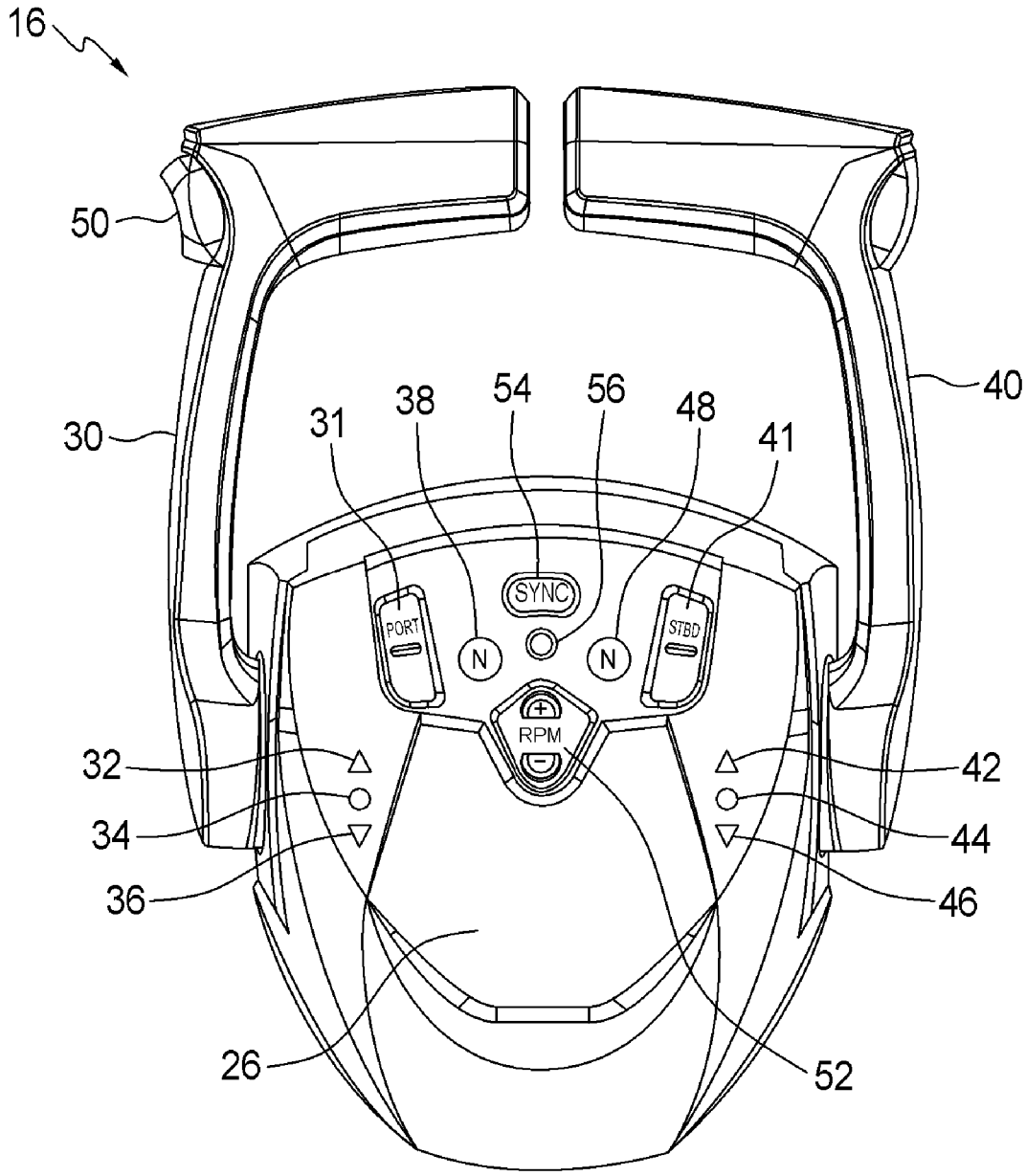
FIG. 3 is a top view of the a control head of the marine vessel of FIG. 1.

The control head 16 is best shown in FIG. 3. The control head 16 includes a housing 26. A port control lever 30 and starboard control lever 40 are each pivotally mounted on the housing 26. The port control lever 30 normally controls the shift and throttle functions of the port engine 12*a* but, in this example, also controls the shift and throttle functions of the center engine 12*b* both of which are shown in FIG. 1. The starboard control lever 40 controls the shift and throttle functions of the starboard engine 12*c* which is also shown in FIG. 1. In a marine vessel with five engines, the port control lever would control the shift and throttle functions of the port, center port and center engines while the starboard control lever would control the shift and throttle functions of the starboard engine and starboard center engine.

The port control lever 30 is provided with a master trim switch 50 which allows an operator to simultaneously trim all of the engines. The port and starboard engines are trimmed individually using a respective port trim button 31 and starboard trim button 41, which are both disposed on the housing 26. The center engine 12*b* is under the control of a center trim button 31 (not shown).

The housing 26 also supports a plurality of indicator or gear lamps which, in this example, are LED lamps. A port forward indicator 32, port neutral indicator 34, and port reverse indicator 36 are disposed on a side of housing 26 adjacent the port control lever 30. A starboard forward indicator 42, starboard neutral indicator 44, and a starboard reverse indicator 46 are disposed on a side of housing 26 adjacent the starboard control lever 40. A port neutral input means 38 and starboard neutral input means 48 are also disposed on the housing 26. An RPM input means 52, synchronization (SYNC) input means 54, and SYNC indicator lamp 56 are also all disposed on the housing 26. In this example, the port neutral input means 38, starboard neutral input means 48, RPM input means 52, and SYNC input means 54 are buttons but any suitable input devices may be used.

Figure 4:
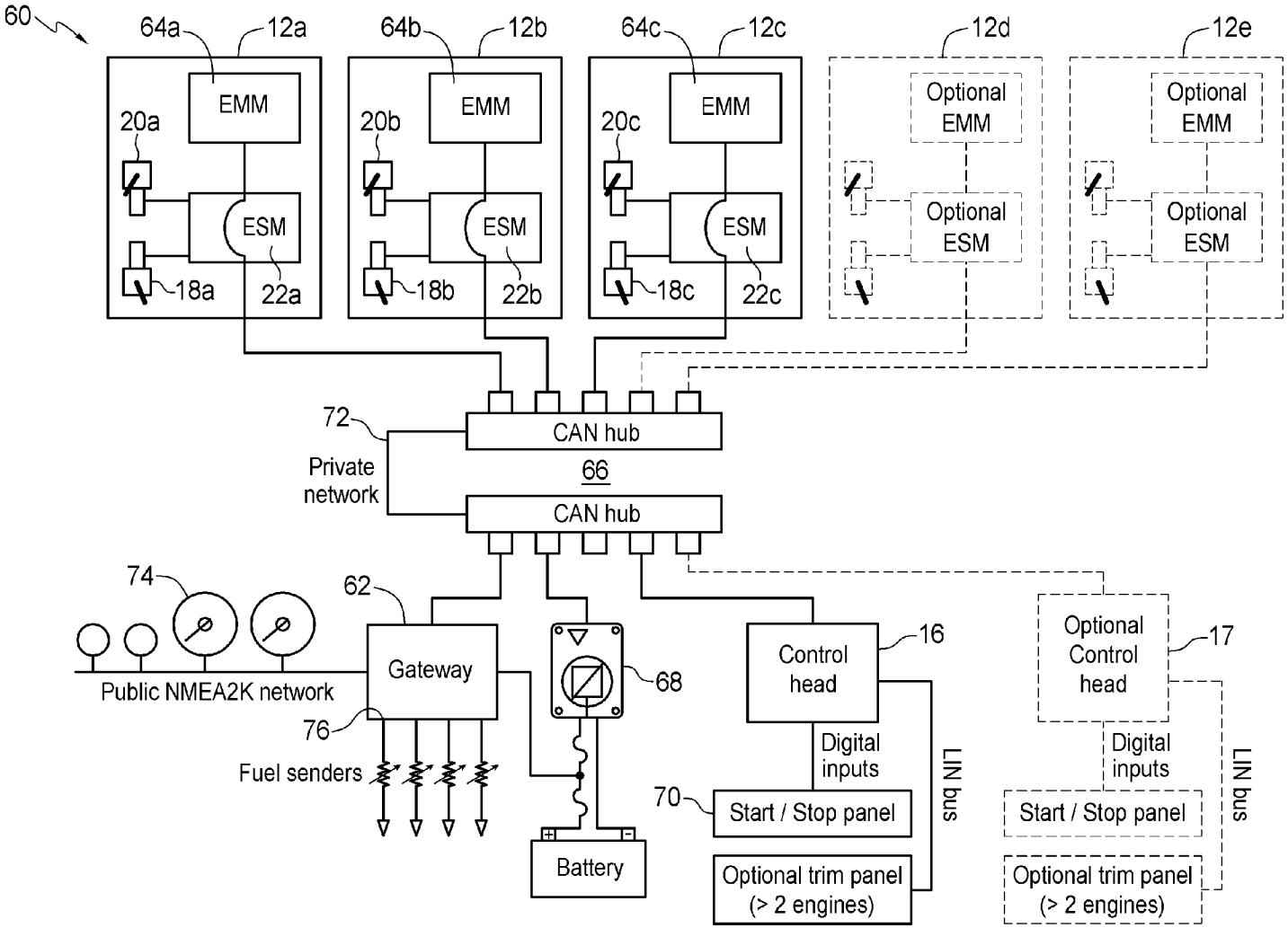
FIG. 4 is a schematic diagram illustrating the electronic shift and throttle system of FIG. 1.

As best shown in FIG. 4, the control head 16 and the engines 12*a*,12*b* and 12*c*, together with their corresponding shift actuators 18*a*, 18*b* and 18*c*; throttle actuators 20*a*, 20*b* and 20*c*; and ESMs 22*a*, 22*b* and 22*c*, form part of an electronic shift and throttle system 60. The electronic shift and throttle system 60 further includes a gateway 62 and a plurality of engine management modules (EMMs) 64*a*, 64*b* and 64*c*. Each EMM is associated with a corresponding ESM. The control head, gateway, ESMs, and EMMs communicate with each other over a private CAN network 66. The electronic shift and throttle system 60 is designed to support two control heads and control up to five engines. Components of optional fourth and fifth engines 12*d* and 12*e* as well as an optional second control head 17 are shown in ghost.

A single master ignition switch 68 provides power to the entire private CAN network 66. However, start and stop functions are achieved by individual switches 70 read by the control head 16 as discrete inputs or serial data. Any command an operator inputs to the control head 16 to start, stop, trim, shift or accelerate one of the engines 12*a*, 12*b* or 12*c* is sent to the corresponding ESM 22*a*, 22*b* or 22*c* and corresponding EMM 64*a*, 64*b* or 64*c* over the CAN network 66. The ESMs and EMMs are each provided with a microprocessor (not shown). In this example, a private network cable 72 that carries the CAN lines from the control head 16 to the engines 12*a*, 12*b* and 12*c* has two separate wires used to shut down the engines in the event that the CAN network 66 fails.

Information from the electronic shift and throttle system 60 is made available to devices on a NMEA2K public network 74 through the gateway 62. The gateway 62 isolates the electronic shift and throttle system 60 from public messages, but transfers engine data to displays and gauges (not shown) on the public network 74. The gateway 62 is also provided with a plurality of analog inputs 76 which may be used to read and broadcast fuel senders or oil senders or other resistive type senders such as rudder senders or trim tab senders on the public network 74.

Figure 5:
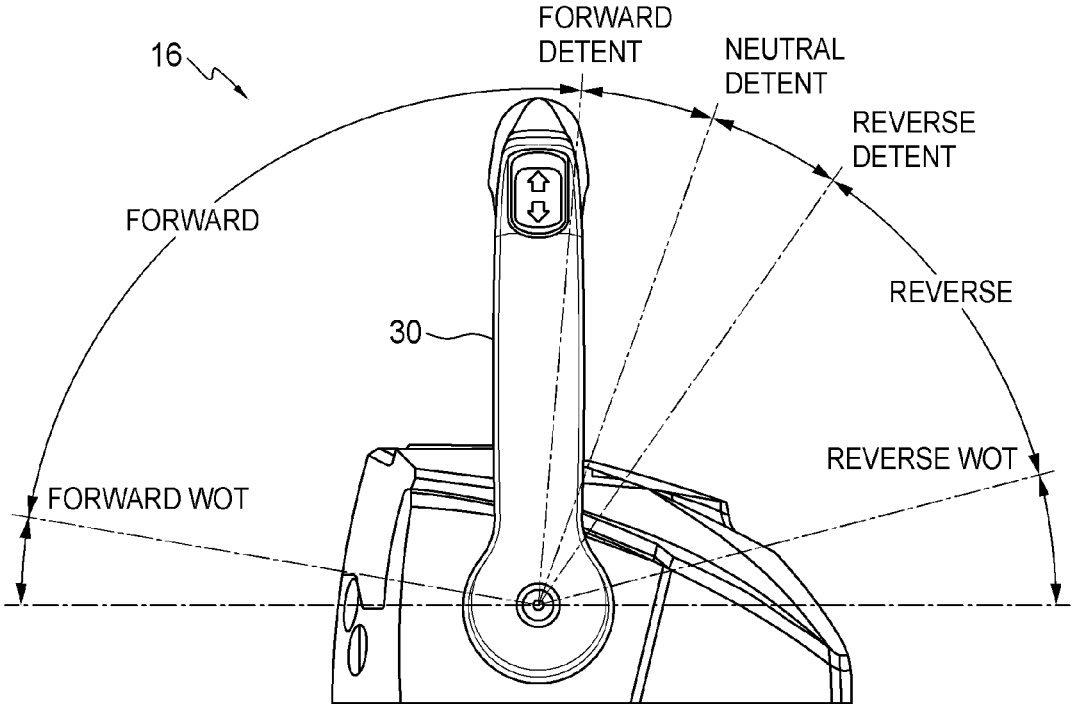
FIG. 5 is an elevation view of the control head of FIG. 3 illustrating an operational range of a control lever thereof.

Referring now to FIG. 5, the port side 30 control lever is moveable between a forward wide open throttle (forward WOT) position and a reverse wide open throttle (reverse WOT) position, through a neutral position. An operator is able to control the shift and throttle functions of the port engine 12*a* by moving the port control lever 30 through its operational range. The port control lever 30 is also provided with a forward detent, neutral detent, and reverse detent all disposed between the forward WOT position and reverse WOT position. This allows the operator to physically detect when the port control lever 30 has moved into a new shift/throttle position. As shown in FIG. 6, the port forward indicator 32, port neutral indicator 34, and port reverse indicator 36 light up to reflect the position of the port control lever 30 shown in FIG. 5.

Figure 7:
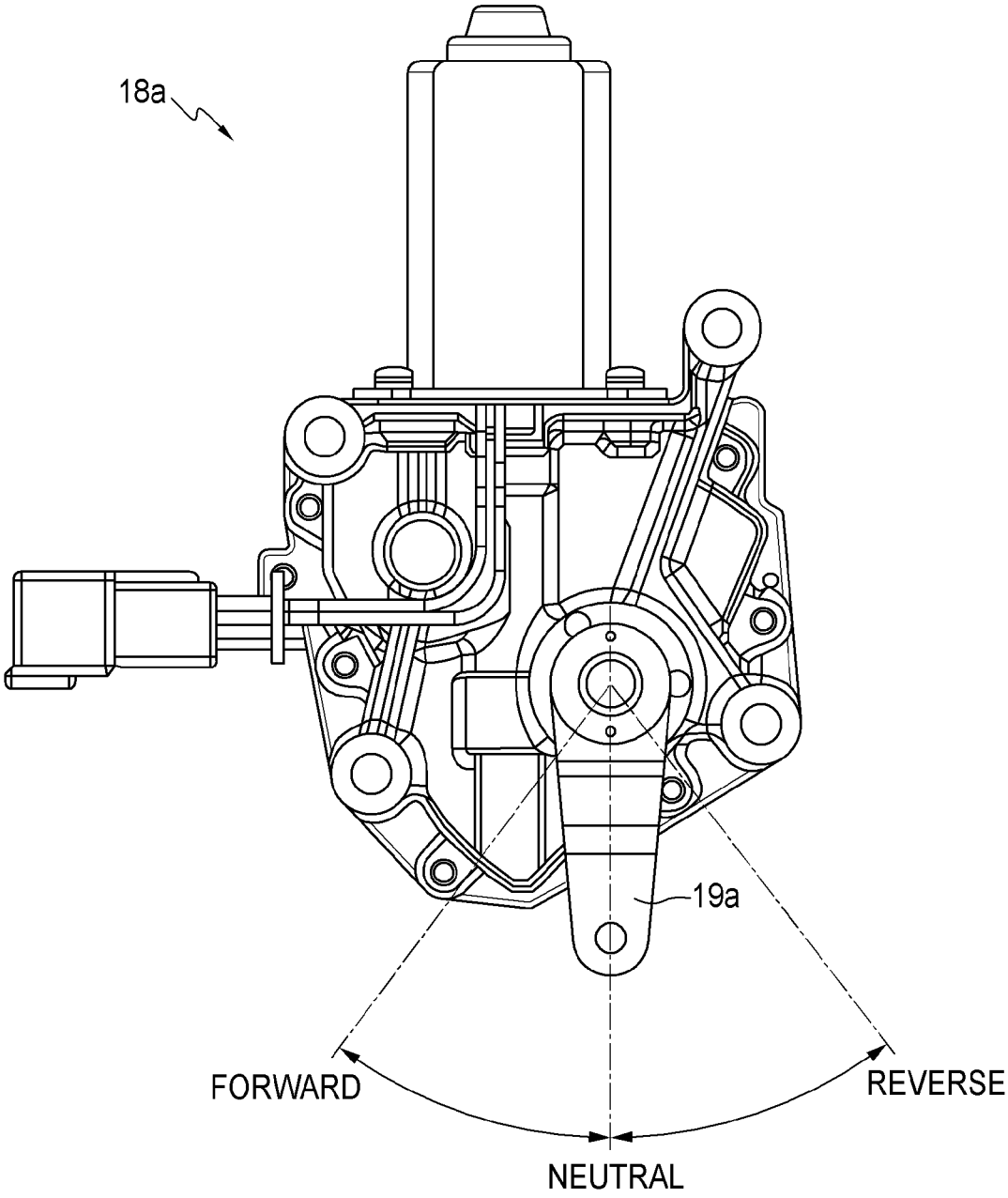
FIG. 7 is side elevation view of a shift actuator of the propulsion unit of FIG. 2 illustrating an operational range of an actuator arm thereof.
Figure 8:
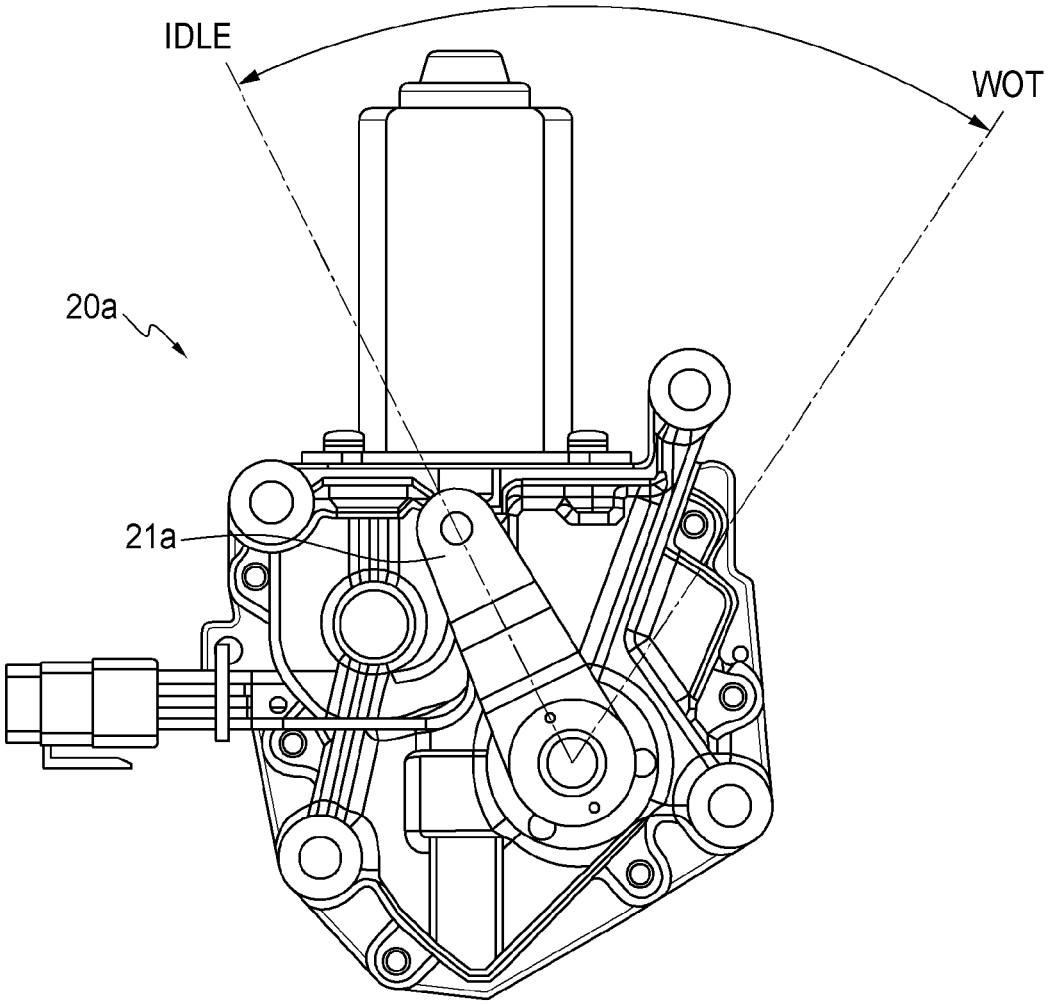
FIG. 8 is a side elevation view of a throttle actuator of the propulsion unit of FIG. 2 illustrating an operational range of an actuator arm thereof.

Referring back to FIGS. 4 and 5, the microprocessor supported by the control head 16 reads the position of the port control lever 30 and sends shift and throttle commands to the ESM 22*a* via the private CAN network 66. The ESM 22*a* commands the shift actuator 18*a* and throttle actuator 20*a* which are best shown in FIGS. 7 and 8, respectively. FIG. 7 shows that the shift actuator 18*a* has an actuator arm 19*a* which is moveable between a forward position and a reverse position with a neutral position therebetween. FIG. 8 shows that the throttle actuator 20*a* has an actuator arm 21*a* which is moveable between an idle position and a wide open throttle (WOT) position. An actuator position sensor 142, shown in FIG. 12, signals the actuator position to the ESM 22*a* shown in FIG. 4. This feedback may be used to govern the control head 16. The shift and throttle functions of the port side engine 12*a* are thereby controlled.

It will be understood by a person skilled in the art that the shift and throttle functions of the starboard engine 12*c* are controlled in a similar manner using the starboard control lever 40 shown in FIG. 2. The shift and throttle functions of the center engine 12*b* are under the control of the port control lever 30 in this example. Accordingly, as thus far described, the electronic shift and throttle system 60 is conventional.

However, the electronic shift and throttle control system 60 disclosed herein is provided with an improved shift actuator 18*a* and throttle actuator 20*a* as shown in Figures actuators as shown in FIGS. 7 and 8 respectively. The shift and throttle actuators are both rotary actuators which have substantially the same structure and function in substantially the same manner, with the exception of the actuator arm 19*a* or 21*a*. This will be understood by person skilled in the art. Accordingly, only the throttle actuator 20*a* is described in detail herein.

Figure 9:
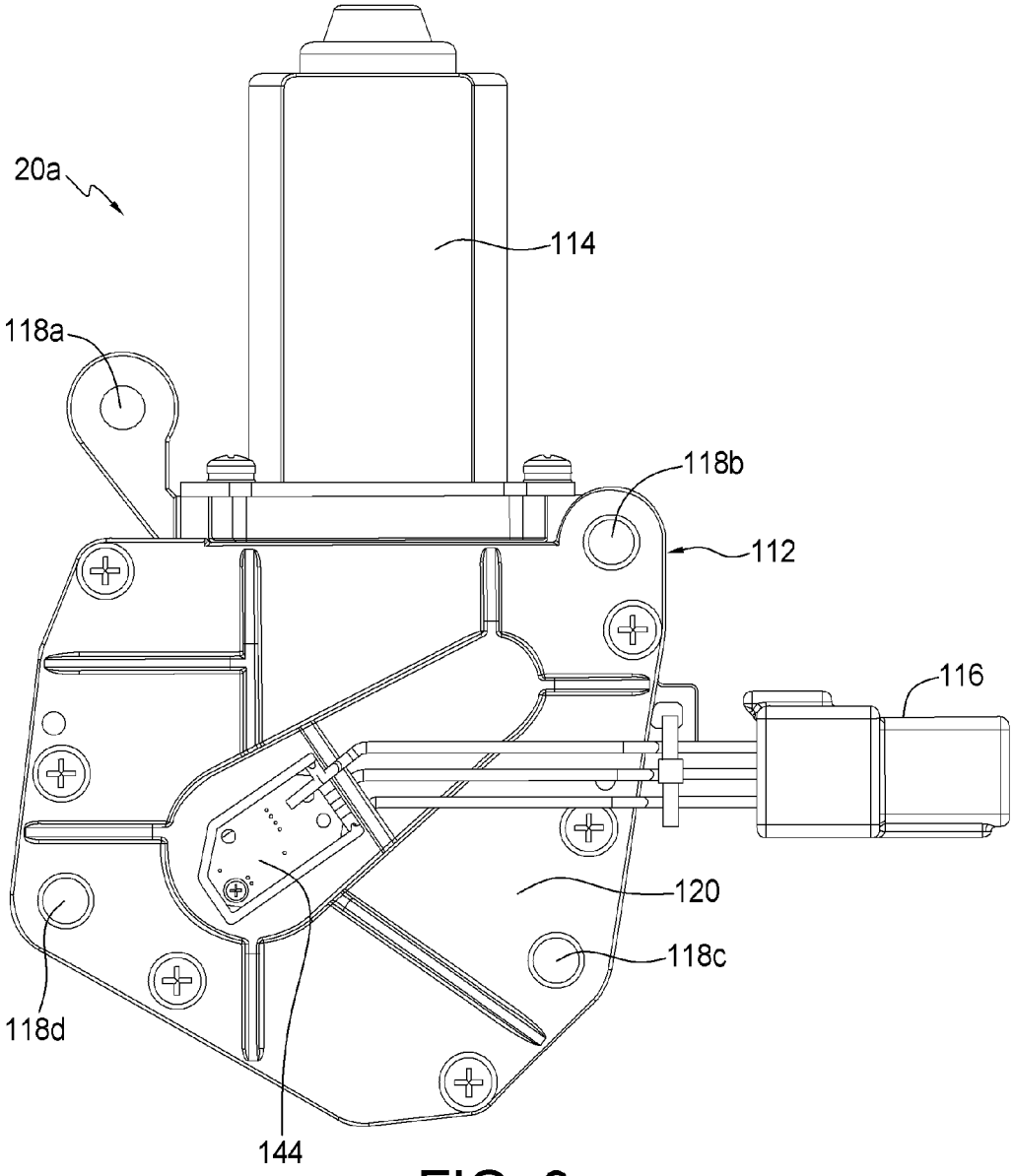
FIG. 9 is a side elevation view of the throttle actuator of FIG. 8 illustrating a second side thereof.
Figure 10:
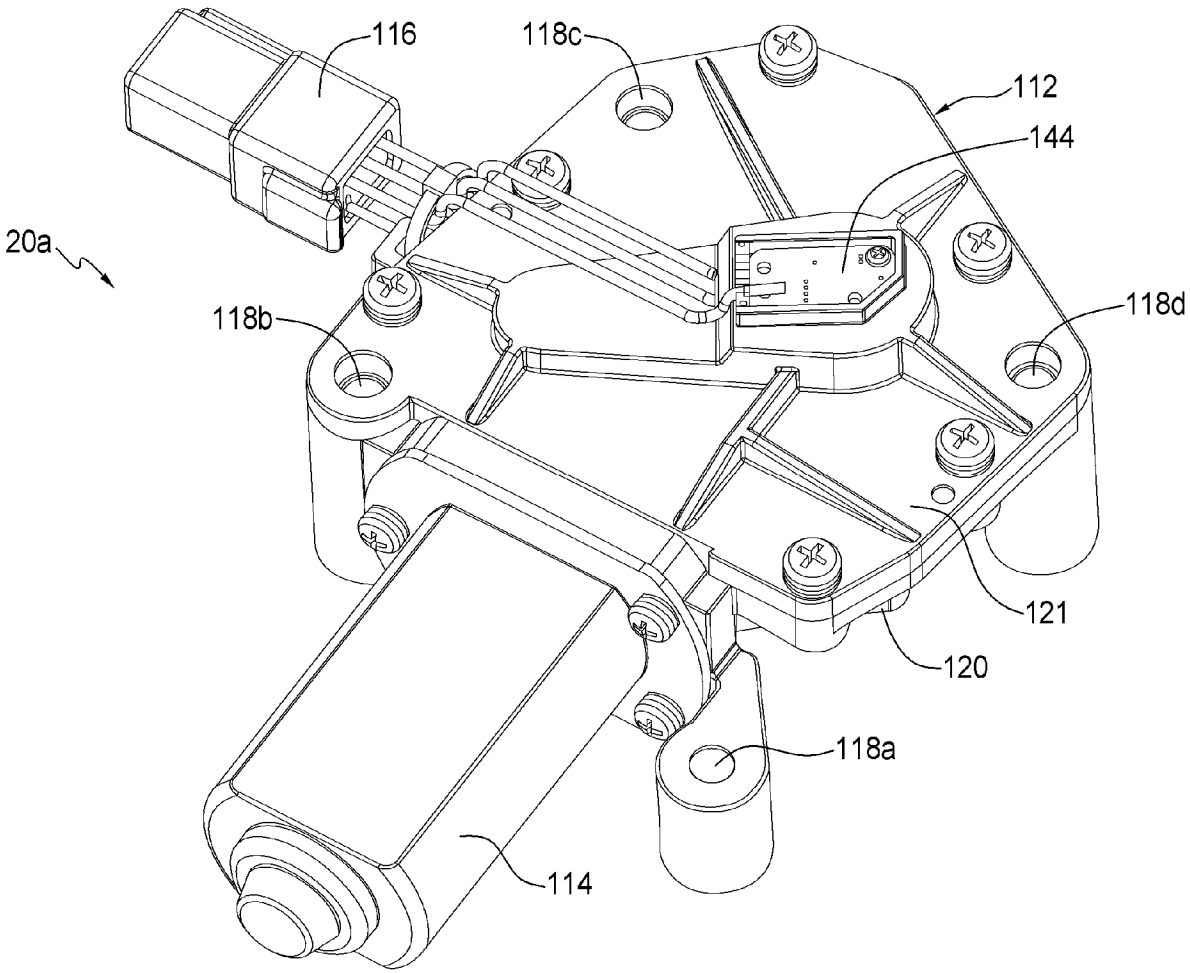
FIG. 10 is a perspective view of the throttle actuator of FIG. 8 illustrating the first side thereof.
Figure 11:
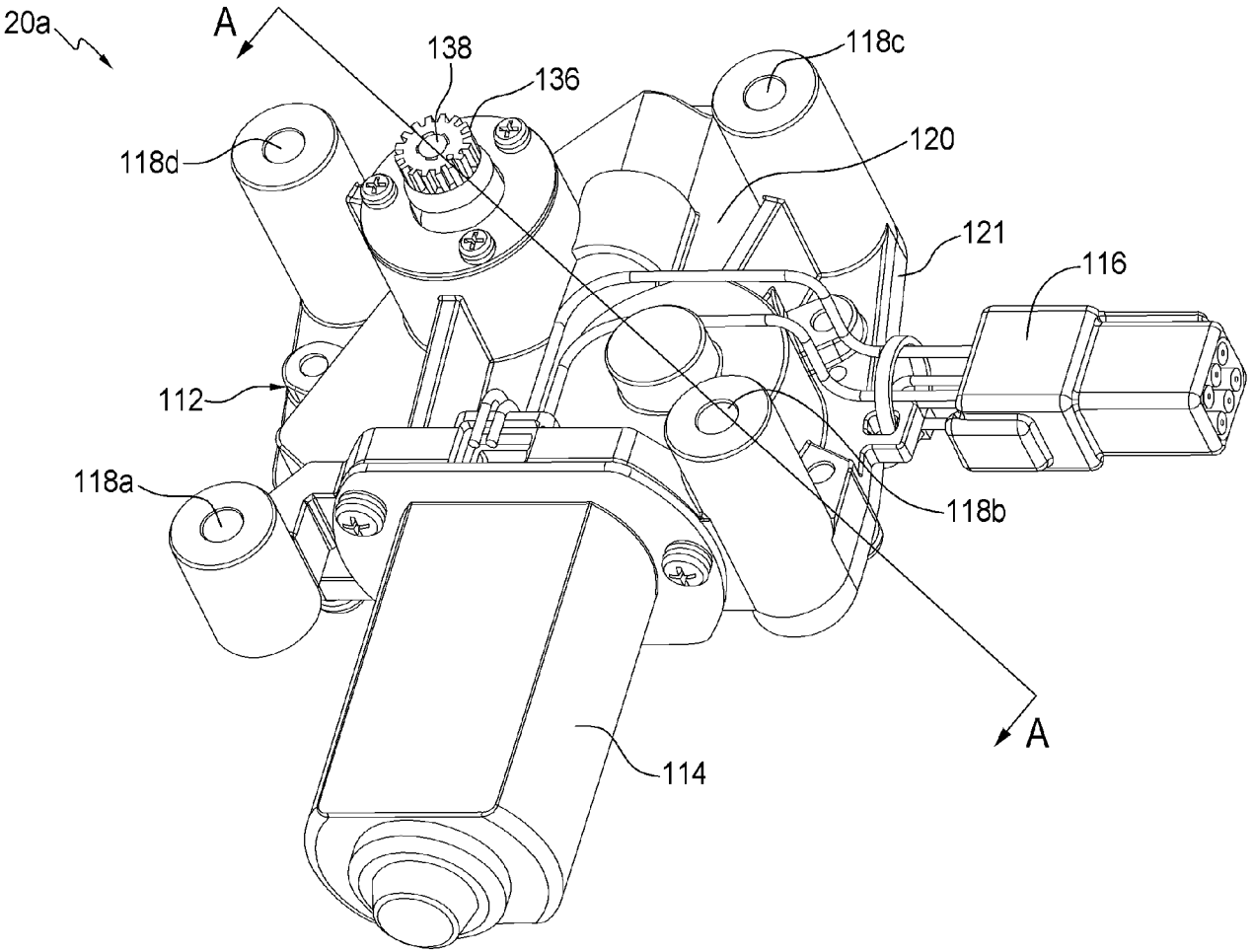
FIG. 11 is a perspective view of the throttle actuator of FIG. 8 illustrating the second side thereof.

Referring to FIGS. 7 through 11, the throttle actuator 20*a* of the port engine 12*a* is shown in greater detail. The throttle actuator 20*a* generally includes a waterproof housing 112 which encases various components, a motor 114 extending from and bolted to the housing 112, and a harness 116 for electrically connecting the throttle actuator 20*a* to the electronic shift and throttle system 60. The housing 112 is provided with a plurality of mounting holes 118*a*, 118*b*, 118*c*, and 118*d* allowing the throttle actuator 112 to be mounted as needed. In this example, the housing 112 also includes a body 120 and a cover 121 bolted the body 120. Removing the cover 121 provides access to the various components encased in the housing 112. The motor 114 may be rotated in either a first rotational direction or a second rotational direction opposite to the first direction depending on the direction of the electric current supplied to the motor 114. As best shown in FIG. 11, the harness 16 is wired to the motor 114 and supplies an electric current thereto.

Figure 12:
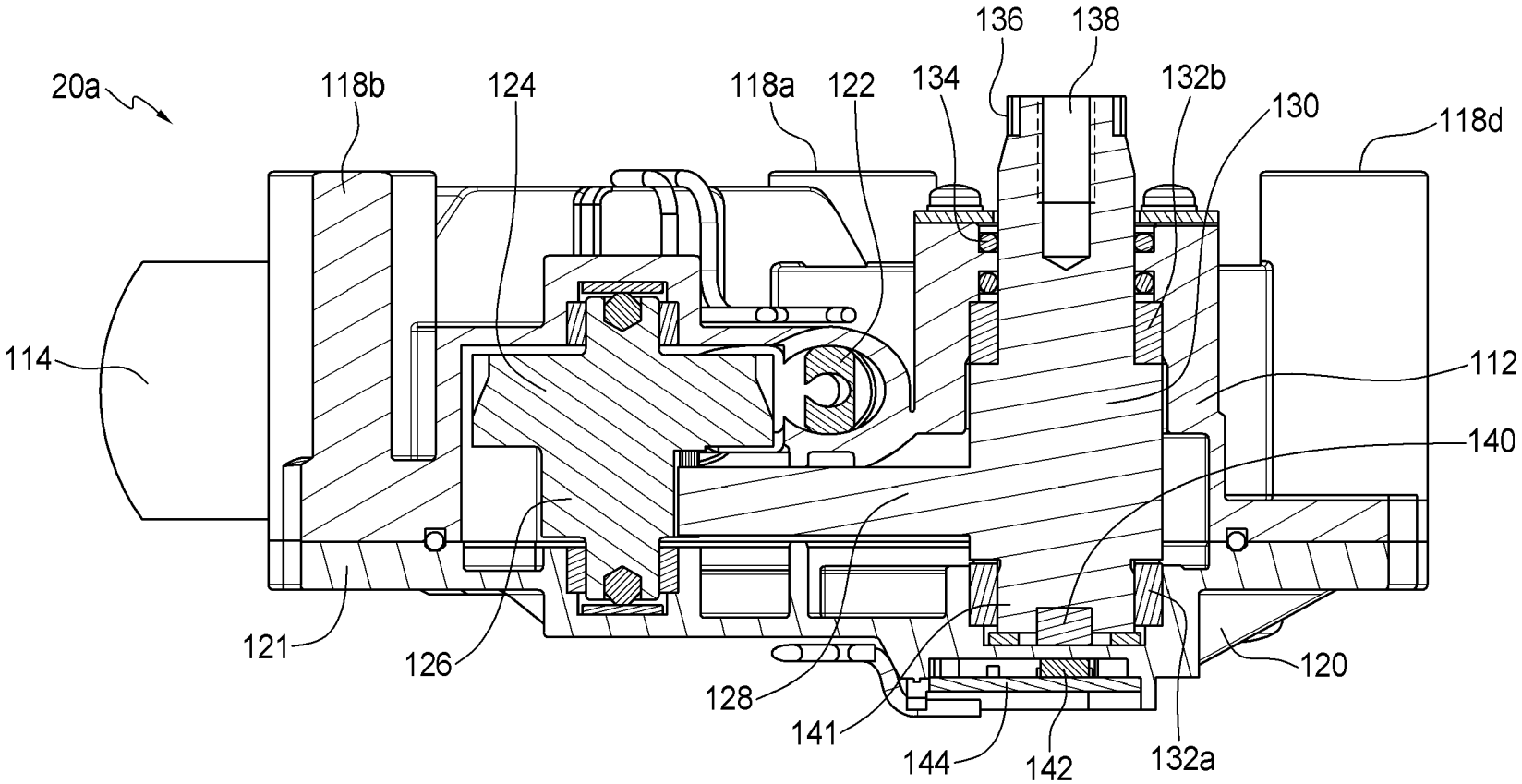
FIG. 12 is a sectional view taken along line A-A of FIG. 11.

Referring now to FIG. 12, the housing 112 encases a worm gear 122 which is coupled to an output shaft (not shown) of the motor 114. The worm gear 122 engages a worm wheel 124 which is integrated with a spur gear pinion 126. The worm gear 122 imparts rotary motion to both the worm wheel 124 and spur gear pinion 126. The spur gear pinion 126 imparts rotary motion to a sector spur gear 128 which is integrated with an output shaft 130 of the throttle actuator 20*a*. The output shaft 130 is thereby rotated by the motor 114. Bearings 132*a* and 132*b* are provided between the output shaft 130 and the housing 112 to allow free rotation of the output shaft 130 within the housing 112. A sealing member in the form of an O-ring 134 is provided about the output shaft 130 to seal the housing.

As best shown in FIG. 11, the distal end 136 of the output shaft 130 is splined. There is a longitudinal, female threaded aperture 138 extending into the output shaft 130 from the distal end 136 thereof. The aperture 138 is designed to receive a bolt to couple the output shaft 130 to the actuator arm 21*a* as shown in FIG. 8. Referring back to FIG. 12, there is a magnet 140 disposed at a proximal end 141 of the output shaft 130. There is also a position sensor 142 which senses a position of the magnet 140 as the output shaft 130 rotates. The position sensor 142 is thereby able to determine the rotating position of the output shaft 142. In this example, the position sensor 142 is a Hall Effect sensor but in other embodiments the sensor may be a magnetoresistive position sensor or another suitable magnetic rotational sensor. The position sensor 142 is mounted on a circuit board 144 which is mounted on the throttle actuator housing 112. More specifically, in this example, the circuit board 144 is mounted on the housing cover 121. As best shown in FIGS. 9 and 10, the circuit board 144 is wired to the harness 116 allowing the position sensor 142 to send an electrical signal to the ESM 22*a* which is shown in FIG. 4.

Figure 13:
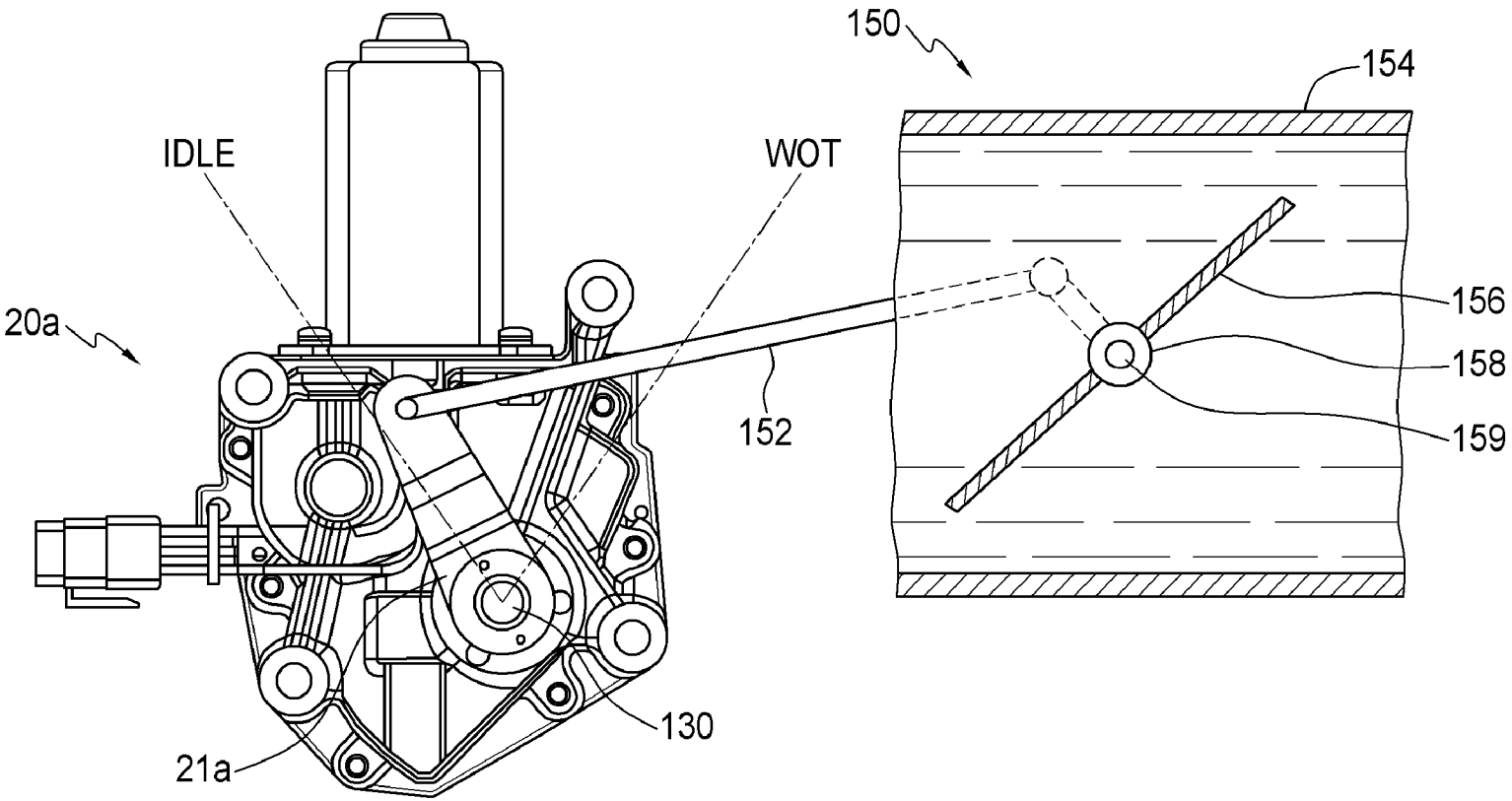
FIG. 13 is a fragmentary side view, partially in section and partly schematic, of the throttle actuator of FIG. 8, a throttle, and a linkage therebetween.

As best shown in FIG. 13, the actuator arm 21*a* is coupled to a throttle 150 of the port engine 12*a*, shown in FIG. 2, by a throttle linkage 152. The throttle 150 includes a throttle body 154 and a throttle plate 156 mounted on a rotatable throttle shaft 158. There is also a throttle position sensor (TPS) 159 mounted on top of the throttle shaft 158 which senses the position of the throttle shaft as it rotates. In this example, the TPS 159 is a potentiometer and communicates with the EMM 64*a* shown in FIG. 4. Together the plate 156, the shaft 158 and the TPS 159 form a butterfly valve member which is spring loaded to a closed position shown in FIG. 14. Referring back to FIG. 13, rotation of the actuator output shaft 130 drives the actuator arm 21*a* to rotate the throttle shaft 158. Rotation of the throttle shaft 158 causes the throttle 150 to move between an idle position shown in FIG. 14 and a WOT position shown in FIG. 15. Whether the throttle 150 is in the idle position or WOT position is dependent on the rotational position of output shaft 130. The throttle actuator 20*a* is an external actuator, the electronic shift and throttle system 60 may be installed as a kit on an existing engine.

To correlate position of the throttle 150 with the position of the actuator arm 21*a*, it is necessary calibrate the throttle controls of the electronic shift and throttle system 60. Once calibrated, the idle position of the actuator arm 21*a* will correspond to the idle position of the throttle 150.

Figure 15:
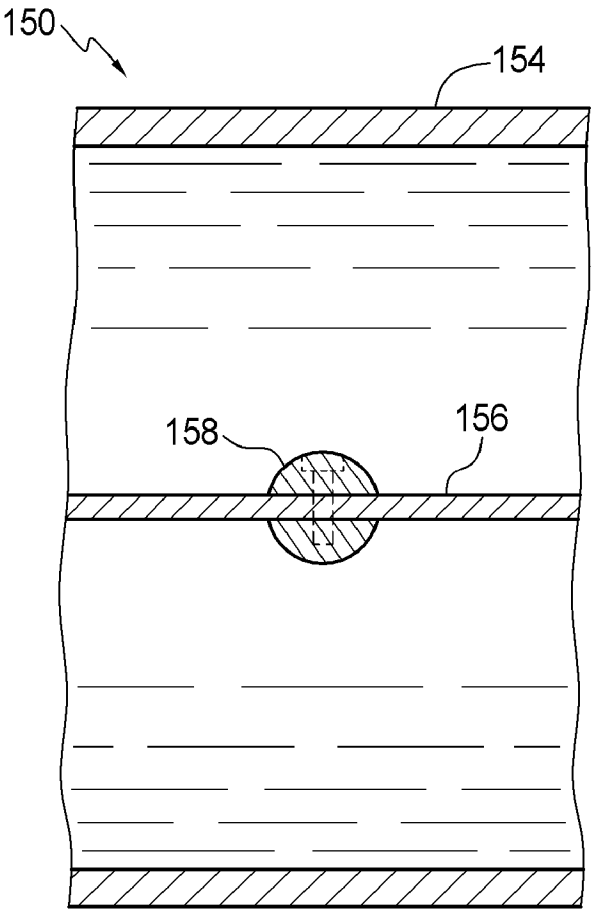
FIG. 15 is a sectional view of throttle of FIG. 13 illustrating the throttle in a wide open throttle (WOT) position.
Figure 14:
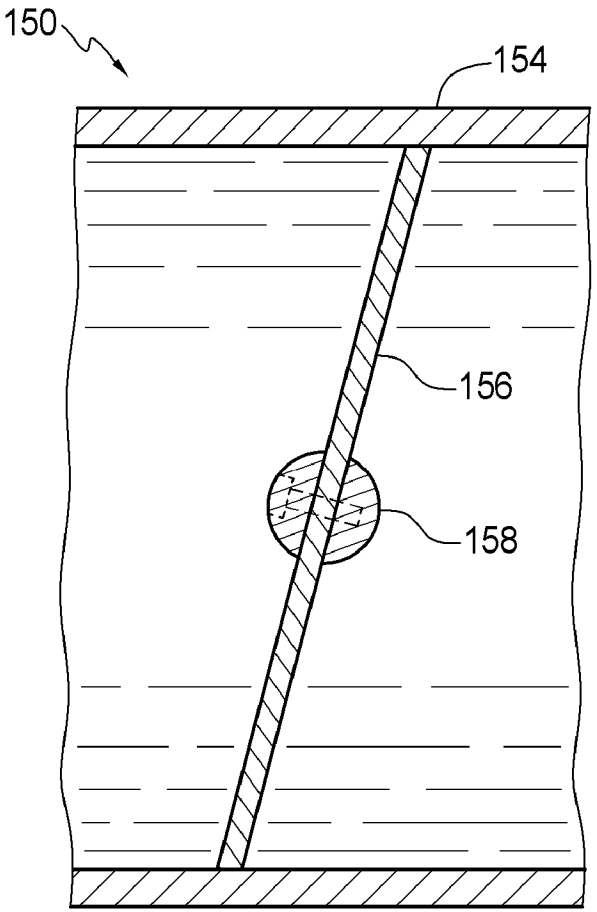
FIG. 14 is a sectional view of the throttle of FIG. 13 illustrating the throttle in an idle position.

The ESM 22*a*, shown in FIG. 4, calibrates the throttle controls by using the voltage level sent by the TPS 159, the duty cycle of the electrical signal sent by the actuator position sensor 142 and the amount of current flowing into the actuator motor 114. The voltage level of TPS 159 varies with the position of the throttle plate 156. In this example, the voltage level of TPS 159 is low when the throttle plate 156 is perpendicular and in contact with throttle housing 154, as shown in FIG. 14, and the voltage level of the TPS 159 is high when the throttle plate 156 is parallel with throttle housing 154 as shown in FIG. 15. The duty cycle of the electrical signal sent by the actuator position sensor 142 varies with the position of the throttle actuator arm 21*a*. In this example and as shown in FIG. 13, the duty cycle of position sensor 142 is low when the actuator arm 21*a* at the idle position and is high when the actuator arm 21*a* is at the WOT position. The amount of current flowing into the actuator motor 114 is low when the actuator arm 21*a* moves freely and increases when the throttle plate 156 is in contact with the throttle housing 154 thereby stalling the motor 114.

Figure 16:
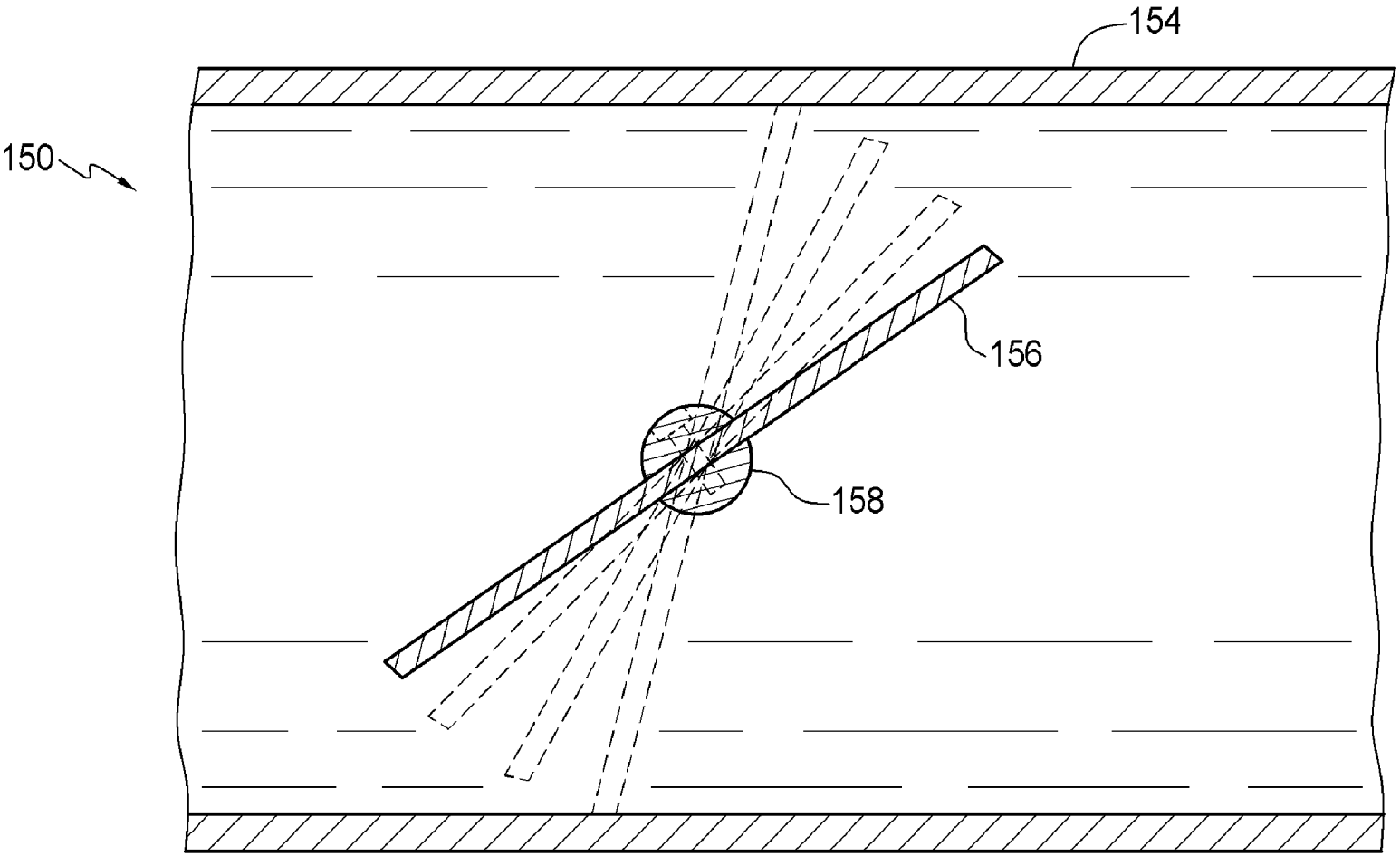
FIG. 16 is a sectional view of throttle of FIG. 13 illustrating movement of the throttle as the throttle controls are being calibrating.

The ESM 22*a* calibrates the throttle controls by determining the throttle position where the TPS voltage is the lowest, while avoiding residual tension in the throttle linkage 152. This is done by 20 opening the throttle 150 and moving it back to the idle position in increments. This is best shown in ghost in FIG. 16. The ESM 22*a* controls the opening of the throttle 150 and moves the throttle 150 back to the idle position. In this example, the throttle 150 is moved back in increments of 1° towards a hard stop, i.e. where the throttle plate 156 comes into contact with the throttle housing 154. At each increment the ESM 22*a* communicates 25 with the EMM 64*a* and requests the voltage level of the TPS 159 shown in FIG. 13. The ESM 22*a* stores the value. This is repeated until the throttle plate 156 comes to the hard stop. The ESM 22*a* determines if the throttle 150 is at the hard stop by measuring the current flowing in the actuator motor 114. The ESM 22*a* assumes that the throttle 150 is at the hard stop if the current is above a pre-determined value. The ESM 22*a* then establishes the idle position as being where the lowest valid voltage level that is at least a minimal distance away from hard stop was measured. The minimal distance from the hard stop ensures that the tension created in the throttle linkage 152 while moving the throttle plate 156 against the hard stop is released. In this example, the minimal distance is defined in degrees and set to 0.75°. However, the minimal distance may range for example between 0.3° and 1.5°.

In this example, the calibration procedure will terminate successfully if the following parameters are met:

1. The voltage level of the signal from the throttle position sensor has changed more than the movement amount while calibrating (in this example 0.2V). This amount confirms the actuator actually moved the throttle plate.
2. The minimum expected idle position voltage level (in this example 0.3V) <=the voltage level of the signal from the throttle position sensor in the idle position <=the maximum expected idle position voltage level (in this example 0.62V).

The values may vary in other embodiments.

Figure 17:
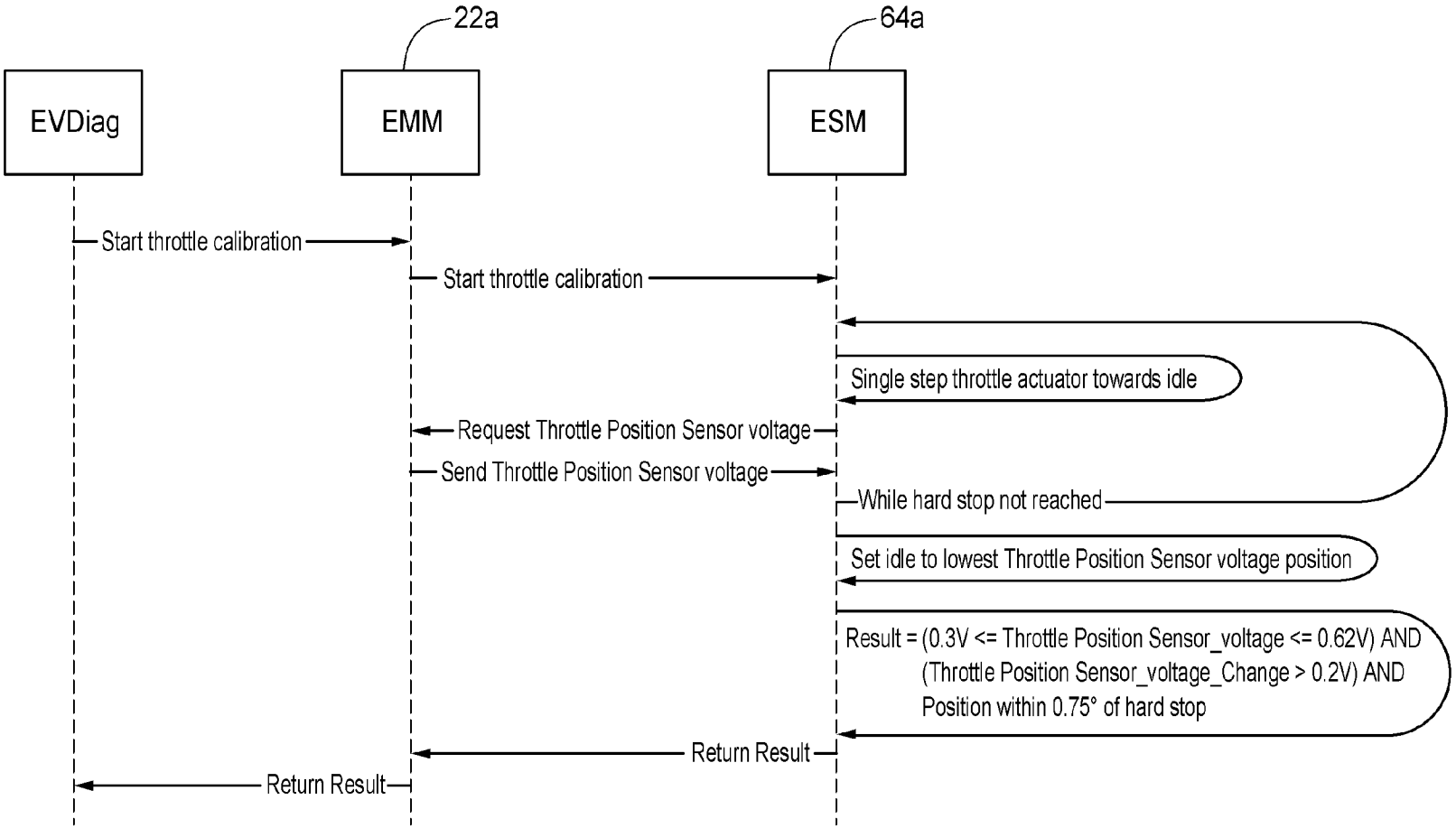
FIG. 17 is a flow chart illustrating the logic of a throttle calibration method disclosed herein.

FIG. 17 best shows the above described calibration procedure. The new calibration position is stored in EEPROM if the calibration procedure terminates successfully. A similar calibration procedure is used for the center and starboard engines.

It will be understood by a person skilled in the art that the method and system for calibrating throttle controls disclosed herein may be implemented in any electronic shift and throttle control system, regardless of where the throttle position sensor is disposed or whether the vehicle is a marine vessel.

It will further be understood by a person skilled in the art that many of the details provided above are by way of example only, and are not intended to limit the scope of the invention which is to be determined with reference to following claims.

What is claimed is:

1. A method of calibrating an idle position of a throttle actuator in an electronic shift and throttle system, the method comprising the steps of:

commanding the throttle actuator to move a throttle towards a hard stop in increments;

measuring a voltage level of an electrical signal sent by a throttle position sensor at each said increment;

recording the voltage level of the electrical signal sent by the throttle position sensor at each said increment;

sensing a position of an actuator arm of the throttle actuator at each said increment; and establishing the idle position as being the position of the actuator arm where the lowest voltage level was measured before the hard stop.

2. The method as claimed in claim 1 wherein the step of establishing the idle position includes establishing the idle position as being where the lowest voltage level was measured when the throttle is at least 0.75° away from the hard stop.

3. The method as claimed in claim 1 further including the step of opening the throttle before moving the throttle towards the hard stop in increments.

4. The method as claimed in claim 1 wherein the step of sensing the position of the actuator arm includes sensing a rotating position of an output shaft which drives the actuator arm.

5. The method as claimed in claim 1 further including the step of storing the idle position in EEPROM.

6. The method as claimed in claim 1 further including the steps of:

determining whether the throttle is at least 0.75° away from the hard stop in the idle position; and storing the idle position in EEPROM if the throttle is at least 0.75° away from the hard stop in the idle position.

7. The method as claimed in claim 1 further including the steps of:

determining whether the voltage level of the electrical signal sent by the throttle position sensor has changed more than 0.2V while calibrating the idle position of the throttle actuator; and storing the idle position in EEPROM if the voltage level of the electrical signal sent by the throttle position sensor has changed more than 0.2V while calibrating the idle position of the throttle actuator.

8. The method as claimed in claim 1 further including the steps of:

determining whether 0.3V is less than or equal to the voltage level of the electrical signal sent by the throttle position sensor when the throttle actuator is in the idle position; and storing the idle position in EEPROM if 0.3V is less than or equal to the voltage level of the electrical signal sent by the throttle position sensor when the throttle actuator is in the idle position.

9. The method as claimed in claim 1 further including the steps of:

determining whether the voltage level of the electrical signal sent by the throttle position sensor is less than or equal to 0.62V when the throttle actuator is in the idle position; and storing the idle position in EEPROM if the voltage level of the electrical signal sent by the throttle position sensor is less than or equal to 0.62V when the throttle actuator is in the idle position.

10. The method as claimed in claim 1 wherein the step of commanding the throttle to move towards the hard stop includes commanding the throttle to move towards the hard stop in increments of 1° towards the hard stop.

11. A method of calibrating an idle position of a throttle actuator in an electronic shift and throttle system, the method comprising the steps of:

commanding the throttle actuator to move the throttle towards a hard stop in increments of 1° towards the hard stop;

measuring a voltage level of an electrical signal sent by a throttle position sensor at each said increment;

recording the voltage level of the electrical signal sent by the throttle position sensor at each increment;

sensing a rotating position of an output shaft of the throttle actuator at each said increment; and establishing the idle position as being the rotating position of the output shaft where the lowest voltage level was measured when the throttle is at least 0.75° away from the hard stop.

12. The method as claimed in claim 11 further including the step of determining whether the following parameters have been met:

(a) the voltage level of the electrical signal sent by the throttle position sensor has changed more than 0.2V while calibrating the idle position of the throttle actuator;

(b) the voltage level of the electrical signal sent by the throttle position is greater than 0.3V when the throttle actuator is in the idle position; and (c) the voltage level of the electrical signal sent by the throttle position sensor is less than or equal to 0.62V when the throttle actuator is in the idle position.

13. The method as claimed in claim 11 further including the step of storing the idle position in EEPROM if all the parameters of claim 12 are met.

14. The method as claimed in claim 11 further including the step of recalibrating the idle position of the throttle actuator if all the parameters of claim 12 are not met.

15. An electronic shift and throttle system comprising:

a throttle actuator including a motor for rotating an output shaft, the output shaft transferring motion to an actuator arm;

an actuator position sensor for sensing a rotating position of the output shaft;

a linkage connecting the actuator arm to a throttle, the throttle being moveable between a hard stop and an open throttle position;

a controller for commanding the throttle actuator to move the throttle towards the hard stop in increments;

a position sensor for sensing a position of the throttle at each said increment;

a memory for recording a voltage level of an electrical signal sent by the throttle position sensor at each said increment; and a microprocessor for correlating the rotating position of the output shaft with the position of the throttle based on the voltage level of the electrical signal, a duty cycle of the actuator position sensor and an amount of current flowing into the motor, wherein the microprocessor establishes as idle position as being the position of the actuator arm where the lowest voltage was measured before the hard stop.

16. An electronic shift and throttle system as claimed in claim 15 wherein the actuator sensor senses the position of a magnet disposed on the output shaft.

17. An electronic shift and throttle system as claimed in claim 15 wherein the controller is an electronic servo module.

* * * * *